US006176928B1

(12) United States Patent
Baughman et al.

(10) Patent No.: US 6,176,928 B1
(45) Date of Patent: Jan. 23, 2001

(54) STAIN MACHINE

(75) Inventors: Jason Baughman, Frazeysburg; Kenny Birkhimer; Mike Harney, both of Dresden; Leane M. Lefever, Frazeysburg; Chauncey Hofacker, St. Louisville, all of OH (US)

(73) Assignee: The Longaberger Company, Newark, OH (US)

( * ) Notice: Under 35 U.S.C. 154(b), the term of this patent shall be extended for 0 days.

(21) Appl. No.: 08/974,859

(22) Filed: Nov. 20, 1997

(51) Int. Cl.[7] ..... B05C 3/00
(52) U.S. Cl. ..... 118/418; 118/417
(58) Field of Search ..... 118/52, 418, 417, 118/19; 68/197; 366/212, 240, 234, 256

(56) References Cited

U.S. PATENT DOCUMENTS 2,034,592 * 3/1936 Newman ..... 118/418
2,369,592 * 2/1945 Marinsky et al. ..... 118/52
3,286,718 * 11/1966 Kumpf ..... 118/418
3,748,249 * 7/1973 Barker ..... 118/418
4,193,700 * 3/1980 Wirz ..... 118/418
4,196,231 * 4/1980 Hiebers ..... 68/197
4,294,626 * 10/1981 Kirisawa ..... 118/52
4,769,117 * 9/1988 Shiono et al. .

* cited by examiner

*Primary Examiner*—Brenda A. Lamb
(74) *Attorney, Agent, or Firm*—Porter, Wright, Morris & Arthur LLP

(57) ABSTRACT

A stain machine including a rotatable drum enclosing a plurality of perforated splint-receiving chambers. The drum is selectively moveable from a soak, or stain-engaging position to a higher spin position, located above the level of the stain in a stain tank. The drum rotates at a first slower speed in its soak position and at a second higher speed in its spin position.

17 Claims, 4 Drawing Sheets

STAIN MACHINE

BACKGROUND OF THE INVENTION

This application relates generally to a device for staining strips of wood veneer. Although this invention has particular utility in the staining of wood veneer splints used as colored accents in handwoven wooden baskets, it also may be useful in staining other small wooden items, such as furniture accents, household items, and children's toys and their components.

Colored accents are a popular feature of certain handwoven wooden baskets. Most commonly, the color of these accents has been created by dyeing the wooden splints. This typically involves immersing the splints in household-type fabric dyes dissolved in hot water. The splints are worked and agitated in the dye solution for a specified time to achieve the most uniform color. The agitation is accomplished manually. Typically, it takes from about 30 minutes to 6 hours for one operator to dye a single standard splint unit. This process is time-consuming and inefficient. The hot water temperature and high humidity associated with this process also can make this operation unpleasant, which may adversely affect retention of employees in this process area.

The color of the dyed splints is affected by dye-lot variations, which are well known in the art. Considerable time is lost and production and disposal costs are increased when a particular lot of dye will not yield the desired color. The color of the dyed splints also may be affected by the water content of the wood, the air temperature, and other variable process conditions. As a result, it is difficult to produce dyed splints having a consistent color.

The household-type dyes also are subject to rapid fading upon exposure to sunlight or fluorescent light. Thus, dyed splints that have been stored in a lighted area for as little as four weeks may differ in appearance from those that are freshly dyed. Deep blues, greens and reds are particularly susceptible to fading. This leads to both waste and production planning problems, as all of the colored splints for a particular product generally must be produced, not only at about the same time, but also close in time to the time when the splints will be needed for production. Any quality problems encountered during the dyeing run may therefore affect production schedules.

Finally, dyed splints have drawbacks in the production of stained baskets, that is, where the entire basket is stained after weaving is completed. Typically, the baskets are stained a medium brown color using a water-based stain, referred to as an overstain. Some overstain color is absorbed by the dyed splints, which may darken and dull the color that was originally present in the dyed splints. As a practical matter, this has limited the accent color selection available for use in stained wooden baskets, because some colors simply are not aesthetically pleasing after they have been overstained. Some dye colors also run when they are re-wet with overstain, causing damage to finished baskets.

Baskets may be left unstained, of course, so that the color of the accent splints remains unaltered by an overstain. However, surface soiling resulting from use is likely to be more apparent on these "natural," or unstained, baskets. The transfer of color from dyed splints to natural splints during the weaving process (which occurs, for example, when a weaver slides horizontal weave strips into position along the vertical basket splints), also is more likely to detract from the appearance of a natural rather than a stained basket. Stained splints are much less susceptible to such color transfer.

It is possible to overcome some shortcomings of dyed basket splints by staining the wooden splints instead. The stained splints may have brighter colors and increased resistance to color transfer during weaving. However, no effective mechanized method of staining splints has been available. Thus, color accent splints generally have been produced by hand rolling the stain onto the splints or hand dipping the splints into a container of stain.

Even with these labor-intensive hand staining methods, care must be taken in prevent spots and drips from forming on the stained splints. The splints may develop spots if they are not separated individually for drying. They also may stick together if excess stain remains on them. Generally, avoidance of these problems requires wiping down the stained splints or hanging them individually to dry. Both processes are time-consuming, and neither is completely effective in preventing spots and drips.

SUMMARY OF THE INVENTION

It is the objective of this invention to provide a device that will allow for the rapid staining of wood veneer splints, or other small wood objects.

It is another objective of this invention to provide a device that will allow application of a stained finish to wood veneer splints to form a finish that is not susceptible to color transfer during weaving, that resists absorption of overstain and running when wet with overstain, that provides more even coverage and more consistent color than dyeing, and that reduces the process time and the waste of materials presently associated with the large-scale production of colored wooden accent splints.

This objective is achieved in a device that includes a rotatable drum. The drum may enclose a plurality of perforated splint-receiving chambers. The drum is selectively moveable from a soak, or stain-engaging position to a higher spin position, located above the level of the stain in a stain tank. The drum rotates at a first slower speed in its soak position and at a second higher speed in its spin position.

A stain-receiving tank capable of receiving a lower portion of the drum cooperates with the moveable drum. The tank may hold a sufficient amount of stain to cause at least some splints in the drum to be wetted by the stain when the drum is in its soak position.

The drum may be further capable of moving from the spin position to a third loading and unloading position, preferably located above the spin position. The drum may be manually rotatable in this loading and unloading position.

These and further objects of the invention will become apparent from the following detailed description.

DESCRIPTION OF THE PREFERRED EMBODIMENT(S)

This stain machine of the present invention includes a rotatable drum into which splints or other objects to be stained are placed. The preferred embodiment is described in terms of a machine for staining wooden splints. The invention, however, is equally applicable to staining of other small parts, including without limitation crib and chair rails, slats or spindles, and children's toys and their components. Thus, as used herein, "splint" includes all items suitable for staining in a machine according to the invention, and is not limited to strips of wood veneer used in making handwoven baskets.

The invention, as applied to staining of colored accents for baskets, contemplates the use of water-based stains. It is expected, though, that the invention also may be suitable for use with other stains if components appropriate to such stains are selected.

Figure 4:
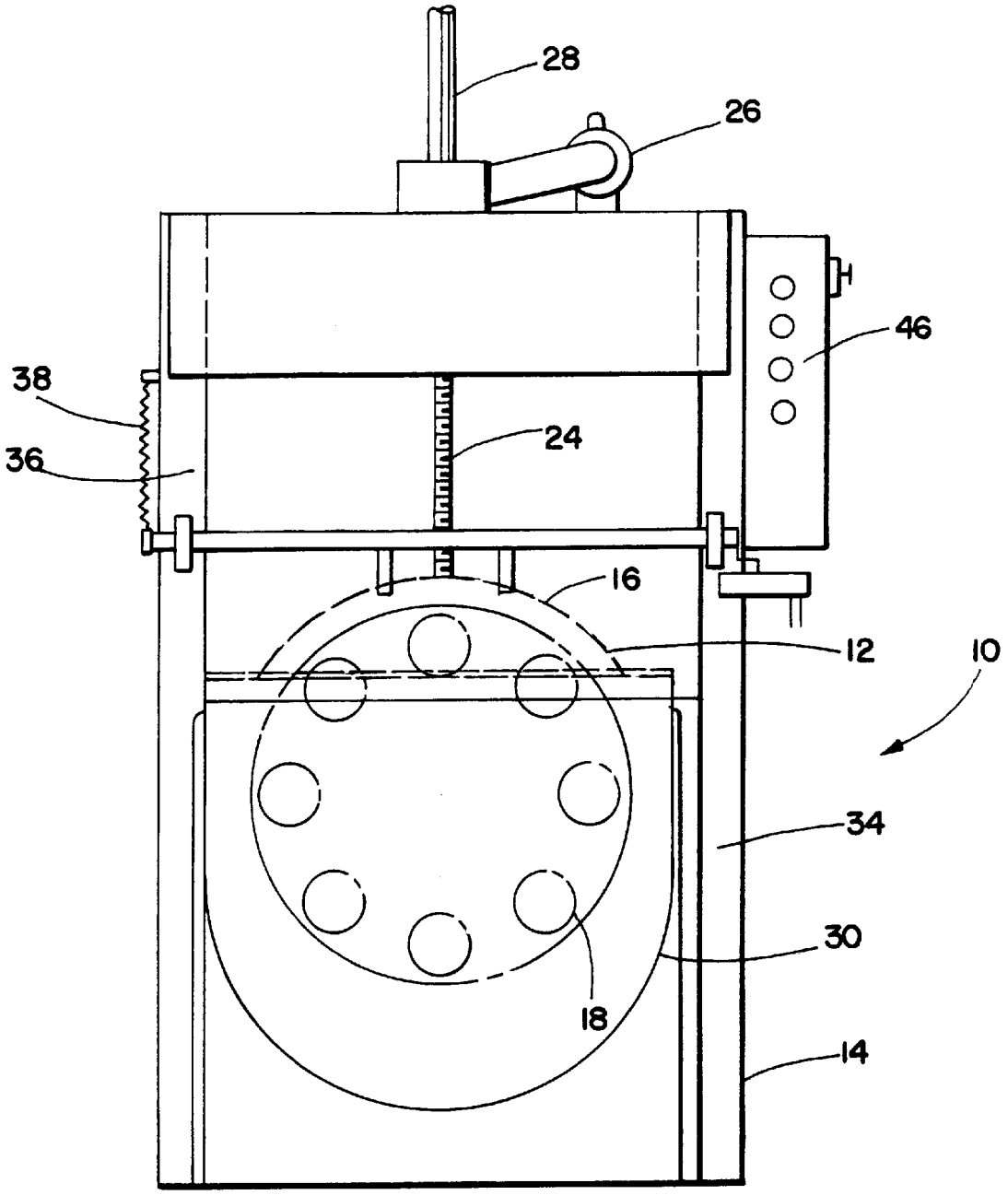
FIG. 4 is a front view of the stain machine in its soak position.
Figure 5:
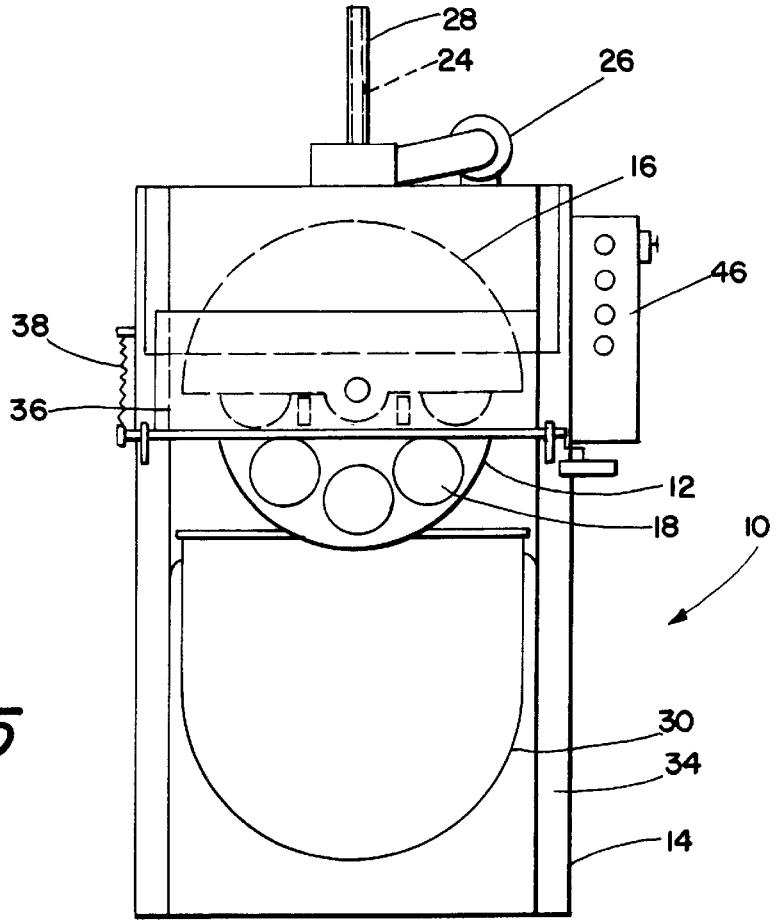
FIG. 5 is a front view of the stain machine in its loading and unloading position.

As shown in FIGS. 4 and 5, the stain machine 10 includes a rotatable splint-receiving drum 12 supported within frame 14. The drum rotates about an axis extending along directional line A—A in FIG. 6. The rotation of the drum is described further below.

The drum 12 has at least one open end oriented to allow splints to be loaded into and unloaded from the drum 12. The drum 12 preferably is divided into a plurality of compartments 18 to separate the splints and allow them greater contact with the stain, thereby providing a more even stain application. However, it would be possible to satisfactorily stain at least a limited number of splints using the device of the present invention even if the drum 12 were not subdivided into compartments 18.

Figure 8:
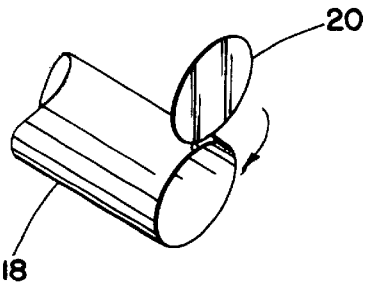
FIG. 8 is a detail schematic view of a cylindrical compartment with an end cap.

Preferably, the compartments 18 are arranged radially within the drum 12 about axis A—A. A cylindrical compartment is preferred because this will allow the splints to move freely when the drum 12 is rotated and assist in thorough wetting of all of the splints in the compartment 18. The compartments 18 may be provided with a closable end cap 20 to contain the splints within the drum 12 during operation of the stain machine 10. For example, an end cap 20 may be provided that pivots from an open loading and unloading position to a closed operating position, as shown in FIG. 8.

The compartments 18 include perforations 22, defined as any openings large enough to allow the facile flow of liquid stain into and out of the compartments 18, but small enough to exclude passage of the splints. This assists in wetting of the splints. It is not necessary that the perforations 22 be distributed uniformly over the surface of the compartment 18, although optimal performance is likely to be achieved if at least about half of the surface area of the compartment wall is perforated. By way of example, satisfactory results have been achieved using cylindrical compartments formed from a first section of unperforated material, such as stainless steel, connected to a second section of perforated material, such as stainless steel mesh, with each section comprising about half of the wall area of the cylinder. If no compartments 18 are provided within the drum 12, the drum 12 itself may include perforations 22.

Figure 1:
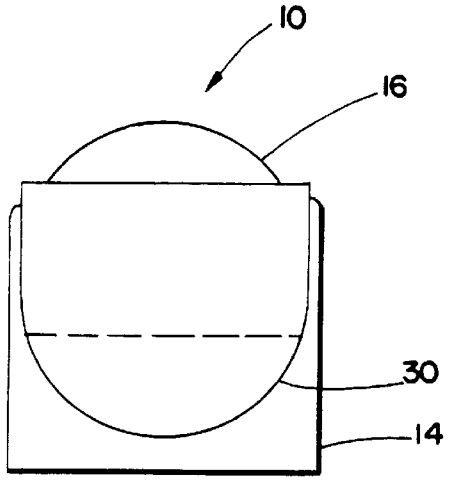
FIG. 1 is a schematic representation of the stain machine of the present invention in its soak position.
Figure 2:
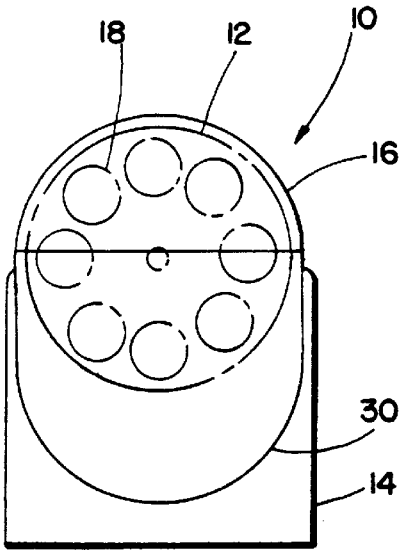
FIG. 2 is a schematic representation of the stain machine in its spin position.
Figure 3:
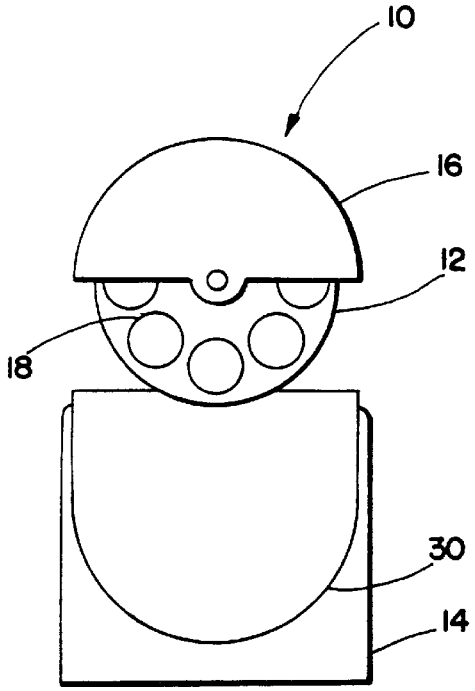
FIG. 3 is a schematic representation of the stain machine in its loading and unloading position.

The drum (partially enclosed within the housing 16) is selectively moveable from a low "soak," or stain-engaging position to a higher "spin," or stain-draining position, best shown in FIGS. 1 and 2. Preferably, the drum 12 also is moveable from the spin position to a still-higher loading and unloading position, shown in FIG. 3. However, the essential functions of the machine could be performed with loading and unloading taking place in the spin position. The drum 12 may be rotatable in its loading and unloading position to ease these operations. Manual rotation of the drum 12 has proved satisfactory, although it also would be possible to use the motor 32, described in more detail below, to rotate the drum 12 in stepwise increments for loading and unloading. Preferably, the drum 12 includes a back balance, or brake, not shown in the drawings, that causes the drum 12 to remain in a desired position when the compartments are loaded unevenly rather than freely rotating to a balance point in response to the load within the drum 12.

Figure 7:
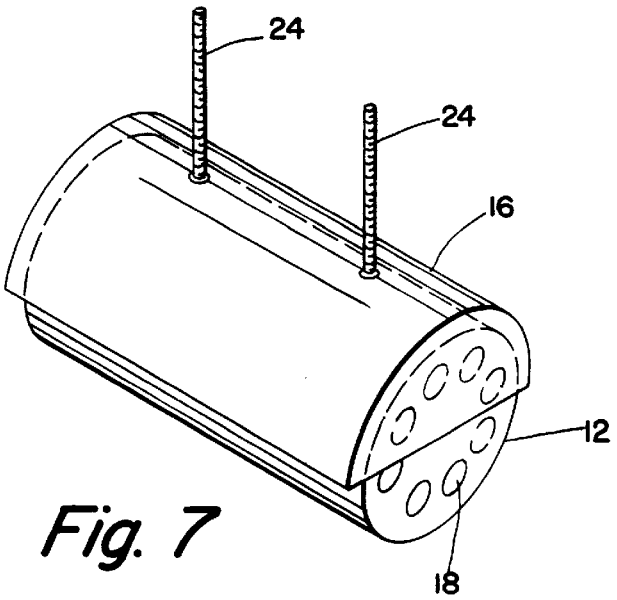
FIG. 7 is a partial schematic view of the housing and threaded rods of the stain machine.

The drum 12 may be connected to a housing 16 that partially surrounds the upper portion of the drum. The housing 16 is connected to threaded rods 24 that move within tubes 28 that extend upwardly from the frame 14, as shown in FIG. 7. The housing 16 also may capture and redirect excess stain, such as the stain that is flung from the drum 12 during the spin portion of the operating cycle, toward the tank 30. A motor 26, shown in FIGS. 4 and 5, causes the rods 24 to move upwardly or downwardly relative to the tubes to move the drum from one vertical position to another. Preferably, the motor 26 is mounted to the top of the frame 14, although other positions also may yield satisfactory results. Other suitable methods for raising and lowering the drum 12 and its housing 16 also may be used.

A stain-receiving tank 30 is required, whether as a separate component or integral with the stain machine, as shown within the frame 14 in FIGS. 4 and 5. The tank 30 is capable of holding a sufficient amount of stain and receiving a lower portion of the drum 12, such that at least some splints placed in the drum 12 are wetted when the drum 23 is in its lowest, soak position. The stain level is shown by the dotted line in FIG. 1. Preferably, the tank 30 is contoured to reduce the amount of stain needed to wet the splints. This also will reduce crevices where stain residues may collect, making tank cleaning easier. About 86 gallons of stain are used in a contoured tank 30 sized to accommodate the drum 12 described herein.

The drum 12 is rotated in its soak position about a horizontal axis at a predetermined speed. Rotation of the drum 12 assists in obtaining satisfactorily stained wooden splints because the splints tend to float on the stain, and, without such rotation, it is unlikely that all of the splints will be completely covered with stain. The number of soak rotations may vary with the stain formulation, as the splints are likely to have differing tendencies to float in stains containing different amounts of solids.

Generally, a short soak time, a low rotation speed (in the range of about 16 RPM) and a small number of rotations are sufficient to achieve satisfactory wetting of wooden splints. For example, as few as four rotations (about 15–25 seconds) have been found to be effective in thoroughly wetting splints to be stained with a bright yellow water-based stain. Although only a small number of rotations are necessary, a longer soak time, greater number of rotations or a higher rotation speed, within reason, are not expected to adversely affect staining performance. A substantially higher rotation speed may, however, result in splashing of the stain, which may affect process economy.

After the appropriate number of soak rotations have been completed, the drum 12 may be raised to the spin position above the level of the stain. The drum 12 is rotated in this position at a second speed faster than the speed of the soak rotations, for example, in the range of about 180 RPM. These rapid rotations spin excess stain off the splints, with the excess stain largely draining back into the tank 30 for reuse. A spin time of about 2 ½ minutes has been found to be effective with stains tested to date.

Figure 6:
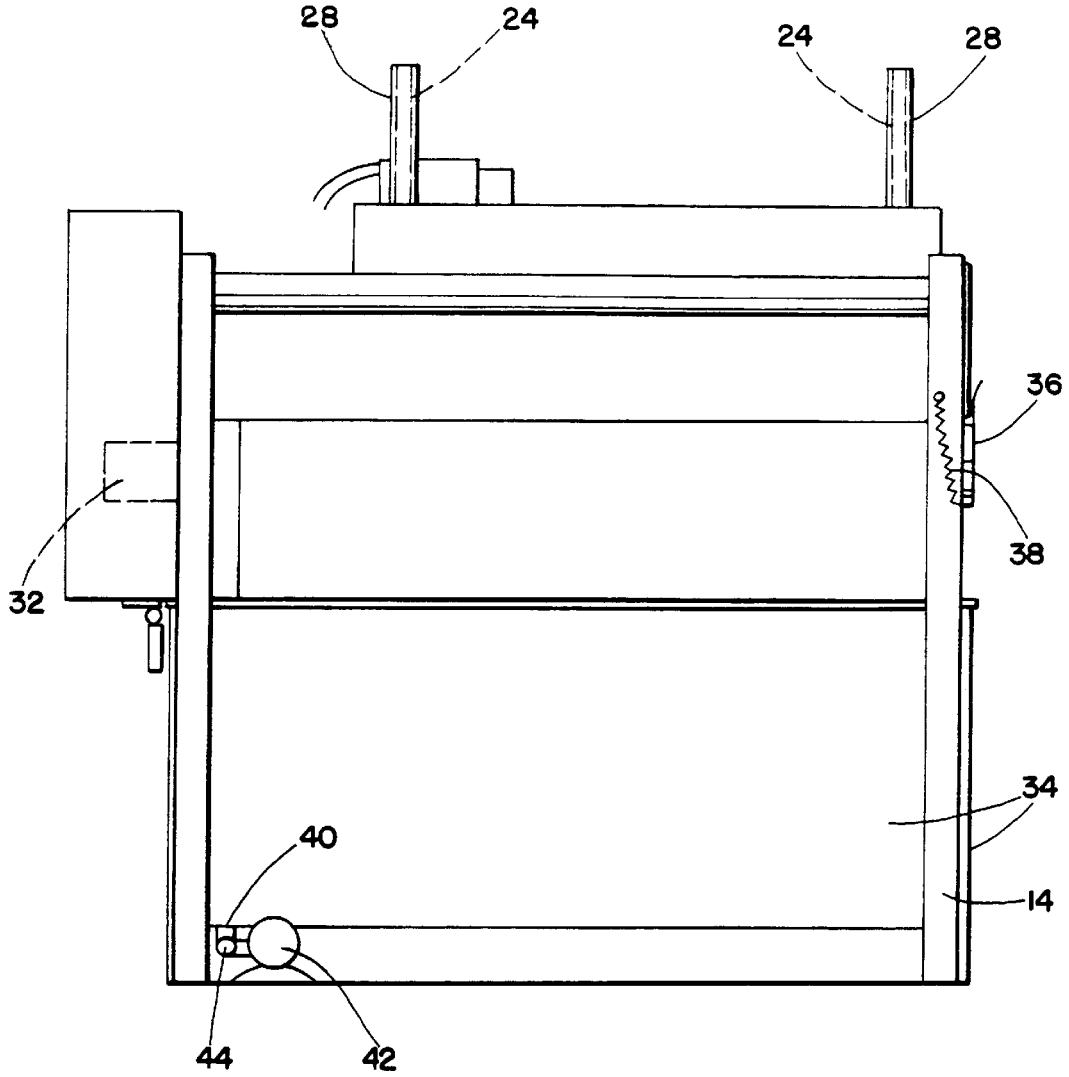
FIG. 6 is a left side view of the stain machine.

A second motor 32 is provided, preferably on the rear of the drum housing 16, as shown in FIG. 6, to cause the drum 12 to rotate. The total cycle time may be as short as about 8 minutes or less. For example, a prototype machine is capable of staining up to eight standard splint units in about 6.5 minutes. By contrast, it typically takes from about 30 minutes to 6 hours for one operator to dye a single standard splint unit. Thus, the process time of the present invention compares favorably with the dyeing process time.

Stained splints produced using the stain machine 10 of the present invention appear to be less susceptible than hand-stained splints to spotting and other surface defects. They also appear less likely to stick together, especially if they are stacked or otherwise come into contact before they are thoroughly dry. However, superior results are achieved when the stained splints are allowed to dry thoroughly before they are stored or used. This may involve air drying or perhaps even a forced-air drying tunnel, with or without the addition of heat.

The frame 14 generally defines an enclosure 34 to contain the stain and assist in capturing excess stain for reuse and to isolate the rotating drum 12 during use. An access door 36 may be provided to allow loading and unloading of the splints. Preferably this door 36 is interlocked to prevent it from opening when the drum 12 is in a position other than the position used for loading and unloading, and particularly when the drum is rotating. It also may be provided with a device, such as spring 38 or a magnetic latch, not shown in the drawings, to maintain the door in an open position during loading and unloading.

The drum 12 and any compartments 18 provided therein may be sized to fit the item(s) to be stained. For wooden splints to be used in handwoven baskets, the drum 12 and its compartments 18 preferably are at least about 60 inches long to comfortably accommodate the longest accent splints typically used. Cylindrical compartments 18 about 6 inches in diameter radially arranged within a 30-inch diameter drum 12 have been used satisfactorily, although other diameters also may be used.

Regardless of the diameter of the compartments 18, optimal results may be obtained if the compartments 18 are not completely filled with splints. Loading a compartment 18 more than about half full is likely to result in uneven staining because too many splints are likely to float. Loads of about one-fourth to one-half of the cylinder diameter are optimal.

The tank 30 preferably is made from stainless steel because it is strong, resistant to abrasion and cleaning solutions that may be required to thoroughly clean the tank before changing to a different stain color, and does not react adversely with the stain. Other nonreactive materials, such as cold-rolled steel, also may be suitable. Aluminum is not suitable because the film formed on its surface upon oxidation affects stain quality.

The stain may be poured directly into the tank 30 through a port (not shown in the drawings) provided in the enclosure 34. For larger or more efficient operation, a pump may be provided to transfer the stain from a storage vessel into the tank 30 through the port.

The tank 30 is positioned within the frame so that it slopes slightly toward an end of the frame 14, toward a drain 40 located in that end of the tank. In FIG. 6, the drain 40 is located in the rear end of the tank, although the drain 40 could be located in other areas of the tank 30 depending upon the slope of the tank 30. Preferably, the stain in the tank 30 is recirculated during staining operations. This recirculation prevents the solids in the stain from settling out of the stain and promotes more even coloration. A recirculation pump 42 may be connected to the drain 40 by a hose or tube 44, with the stain being transferred from the drain 40 to the stain intake port.

Stain may be emptied from the tank 30 by connecting a hose to the drain 40, although preferably a pump is also used. The recirculation pump 42 may be used for this purpose, although a dedicated pump may be provided if process demands so require. Any suitable pump(s) capable of transferring the desired quantity of stain may be used for filling, recirculating and draining, including diaphragm-type air pumps.

Simple operating controls 46 may be provided on the frame 14, preferably conveniently accessible to the loading and unloading access 36. These controls 46 may include, for example, a start cycle switch, manual up and down switches to raise and lower the drum 12 without rotation, and an emergency stop switch. The controls 46 may be connected to a touch-pad programmable controller, such as those available from Allen Bradley, not shown in the drawings, which may be used to select cycle lengths and rotation speeds.

Although a particular embodiment of the present invention has been described in detail, other embodiments are within the scope of this invention. Variations may be made to the described embodiment by those skilled in the art without departing from the spirit of the invention or the scope of the appended claims.

We claim:

1. A device for staining wooden splints, comprising:

a splint-receiving drum defining a plurality of perforated splint-receiving compartments;

means for rotating said drum about a horizontal axis;

means for selectively moving said drum from a stain-engaging soak position to a stain-draining spin position above said soak position; and a stain-receiving tank for receiving a lower portion of said drum when said drum is in said soak position.

2. The device according to claim 1, wherein the tank is capable of holding a sufficient amount of stain to cause portion of the splints in the drum to be wetted by the stain when the drum is in its soak position.

3. The device according to claim 1, wherein the means for rotating said drum is a drum-rotating motor, said motor causing said drum to rotate at a first speed in its soak position.

4. The device according to claim 3, wherein said motor causes the drum to rotate at a second speed in its spin position.

5. The device according to claim 1, wherein the means for rotating said drum comprises a drum-rotating motor, said motor causing the drum to rotate at a first speed in its soak position and at a second speed in its spin position, said second speed being faster than said first speed.

6. The device according to claim 1, wherein the drum may be rotated to facilitate loading and unloading of splints.

7. The device according to claim 1, wherein the compartments are cylindrical.

8. The device according to claim 7 wherein the compartments are arranged radially within the drum.

9. The device according to claim 7, wherein the compartments have a pivotable end cap.

10. The device according to claim 9, further including:

a back balance connected to the drum such that the drum will remain in a desired position during loading or unloading even when the compartments are loaded unevenly.

11. The device according to claim 1, wherein the means for moving the drum causes the drum stain held in the tank and the rotation of the drum about a horizontal axis assists in wetting splints received in the drum when the drum is in its soak position.

12. A stain machine, comprising:

a stain-receiving tank;

a drum;

means for rotating said drum about a horizontal axis;

means for selectively moving said drum from a first stain-engaging soak level to a second stain-draining spin level above said soak level; and a perforated splint-receiving chamber enclosed within the drum, a portion of said chamber being receivable within the tank such that splints placed within the chamber may be wetted by stain received within the tank.

13. The stain machine according to claim 12, wherein:

said means for selectively moving said drum provides for moving said drum from the spin level to a third loading and unloading level above the spin level.

14. The device according to claim 12, wherein the rotation of the drum about a horizontal axis assists in wetting splints received in the chamber when the drum is in its soak position.

15. A stain machine, comprising:

a drum enclosing plurality of perforated splint-receiving chambers;

means for selectively moving said drum from a stain-engaging soak position to a stain-draining spin position above said soak position;

a stain-receiving tank capable of holding a sufficient amount of stain and receiving a lower portion of the drum such that at least some splints received in the chambers are wetted by stain held within the tank when the drum is in its soak position; and a drum-engaging motor causing the drum to rotate at a first lower speed in its soak position and at a second higher speed in its spin position.

16. The stain machine according to claim 15, wherein the drum-engaging motor causes said drum to rotate about a horizontal axis.

17. The stain machine according to claim 16, wherein the rotation of the drum about a horizontal axis assists in wetting splints received in the chambers when the drum is in its soak position.

* * * * *